US006270082B1

(12) United States Patent
Hegemier

(10) Patent No.: US 6,270,082 B1
(45) Date of Patent: Aug. 7, 2001

(54) COEXTRUDED VALVE STEM SEAL

(75) Inventor: Timothy A. Hegemier, Avilla, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/395,808

(22) Filed: Sep. 14, 1999

(51) Int. Cl.[7] ..... F02F 11/00; F16J 3/00; F16J 15/12; F16L 9/14

(52) U.S. Cl. ..... 277/502; 277/634; 277/654; 138/141

(58) Field of Search ..... 277/502, 585, 277/607, 627, 634, 635, 636, 650, 654; 138/141, 126, 109

(56) References Cited

U.S. PATENT DOCUMENTS

| | | | | |
|---|---|---|---|---|
| 2,821,973 | | 4/1958 | Guhman | 123/188 |
| 3,333,578 | | 8/1967 | Müller | 123/188 |
| 3,797,754 | * | 3/1974 | Spencer . | |
| 3,825,036 | * | 7/1974 | Stent . | |
| 3,885,546 | * | 5/1975 | Foley et al. . | |
| 4,083,332 | * | 4/1978 | Neveux . | |
| 4,136,149 | * | 1/1979 | Payne . | |
| 4,325,558 | * | 4/1982 | Poggio . | |
| 4,707,389 | * | 11/1987 | Ward . | |
| 4,967,609 | * | 11/1990 | Takagi . | |
| 5,002,018 | | 3/1991 | Strout | 123/188 |
| 5,110,142 | * | 5/1992 | Szott . | |
| 5,533,985 | * | 7/1996 | Wang . | |
| 5,553,869 | | 9/1996 | Stamback | 277/33 |
| 5,736,091 | * | 4/1998 | Scarazzo et al. . | |
| 5,775,284 | | 7/1998 | Kirchner et al. | 123/188 |

FOREIGN PATENT DOCUMENTS

1126100 * 9/1968 (GB) .

* cited by examiner

*Primary Examiner*—Chuck Y. Mah
*Assistant Examiner*—Vishal Patel
(74) *Attorney, Agent, or Firm*—Rader, Fishman & Grauer PLLC

(57) ABSTRACT

A coextruded valve stem seal is provided that includes a sleeve having an upper and lower portion, a central vertical axis, and a generally concentric aperture. The sleeve includes an inner layer an inner layer of a resilient sealing material, such as a rubber, and an outer layer of a coextrudable rigid material, such as a plastic material. The lower portion of a preferred embodiment of the sleeve may include a radially extending flange. A method for making the valve stem seal in accordance with the principles of the invention is also disclosed.

10 Claims, 1 Drawing Sheet

COEXTRUDED VALVE STEM SEAL

FIELD OF THE INVENTION

The present invention generally relates to valve stem seals. More particularly, the present invention relates to a coextruded valve stem seal that is suitable for use in an internal combustion engine.

BACKGROUND OF THE INVENTION

In a high-temperature, high-wear environment, such as an internal combustion engine, valve stems and guides will scuff and wear excessively if they are not adequately lubricated. Conversely, too much oil produces a heavy build up of deposits that can eventually cause significant engine problems. Valve stem seals are used to control the amount of oil allowed between a valve stem and a valve stem guide.

In the assembly of a valve system for an engine, it is important that the valve stem fit within an allowable tolerance in the valve stem guide. The valve stem seal is typically provided on the upper end of the valve stem to minimize the amount of oil that runs down the valve stem into the cylinder bore. A valve stem seal generally includes a sleeve designed to secure the seal to a valve stem guide. The inside diameter of the sleeve interfaces with and engages the outside diameter of the guide. The sleeve usually includes a sealing element that is centered about the valve stem to meter the oil that lubricates the inner diameter valve stem interface.

To a significant extent, the effectiveness of the valve stem seal depends on the manner to which the seal is secured to the guide. If the sleeve is not properly positioned in relation to the valve guide, the sealing element might not properly seat upon the valve stem, causing non-uniform contact pressure at the valve stem, undesirable wear patterns on the components, and unpredictable oil control for the valve stem.

Two-component valve stem seals having an inner resilient member and an outer rigid member (and, optionally, a reinforcing spring) are known in the industry. Such conventional seals usually consist of an inner rubber material that is covered by a separately formed outer metal or ceramic material. Because the inner and outer components are formed separately in different manufacturing phases, additional processing techniques or steps are often required to durably connect and/or bond the components to one another. There are a number of disadvantages associated with forming a two-component seal in such a manner. In addition to increasing the chance for misalignment and a poor fit between the inner and outer components, such additional processing techniques or steps may involve supplementary manufacturing techniques, production equipment and tooling, thereby increasing the costs associated with the production of an acceptable valve stem seal assembly.

SUMMARY OF THE INVENTION

The present invention recognizes the limitations associated with currently available valve stem seal assemblies and the production thereof. A principal feature of the present invention is the formation of a valve stem seal by means of a coextrusion technique. By coextruding the inner resilient material and the outer more rigid material, the integrity of the resulting article is improved and the associated design and manufacturing processes can be simplified or reduced. By simplifying the production process, the associated machinery, tooling, manufacturing techniques and costs may be reduced—resulting in the production of a less expensive, better-aligned, and more cohesive multi-component valve stem seal.

A further advantage of utilizing a coextrusion process to form the valve stem seal is the ability to easily adjust or vary the thickness of one or both of the layers of the seal along its length using conventional equipment. By adjusting the thickness of the layers of the valve stem seal, more or less material can be positioned as desired to better meet the needs of the intended application.

In accordance with an embodiment of the invention, a valve stem seal is provided which includes a coextruded sleeve having an upper and lower portion, a central vertical axis and a generally concentric aperture. The sleeve includes an inner layer comprised of a resilient sealing material and an outer layer comprised of a plastic material. In a preferred embodiment of the invention, the lower portion of the sleeve includes a flange having a generally planar bottom surface that extends radially outward. Preferably, the resilient sealing material of the inner layer is made of a rubber material and the outer layer is made of a rigid plastic material. If necessary or desirable, the upper portion of the sleeve may include a metal spring reinforcement to help increase the useful life of the part.

A method for making an improved valve stem seal as described above is also disclosed as a further aspect of the present invention. By reducing the number of processing steps needed to manufacture the valve stem seals, the disclosed method provides a number of advantages over present valve stem seal construction techniques.

BRIEF DESCRIPTIONS OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENT

Figure 1:
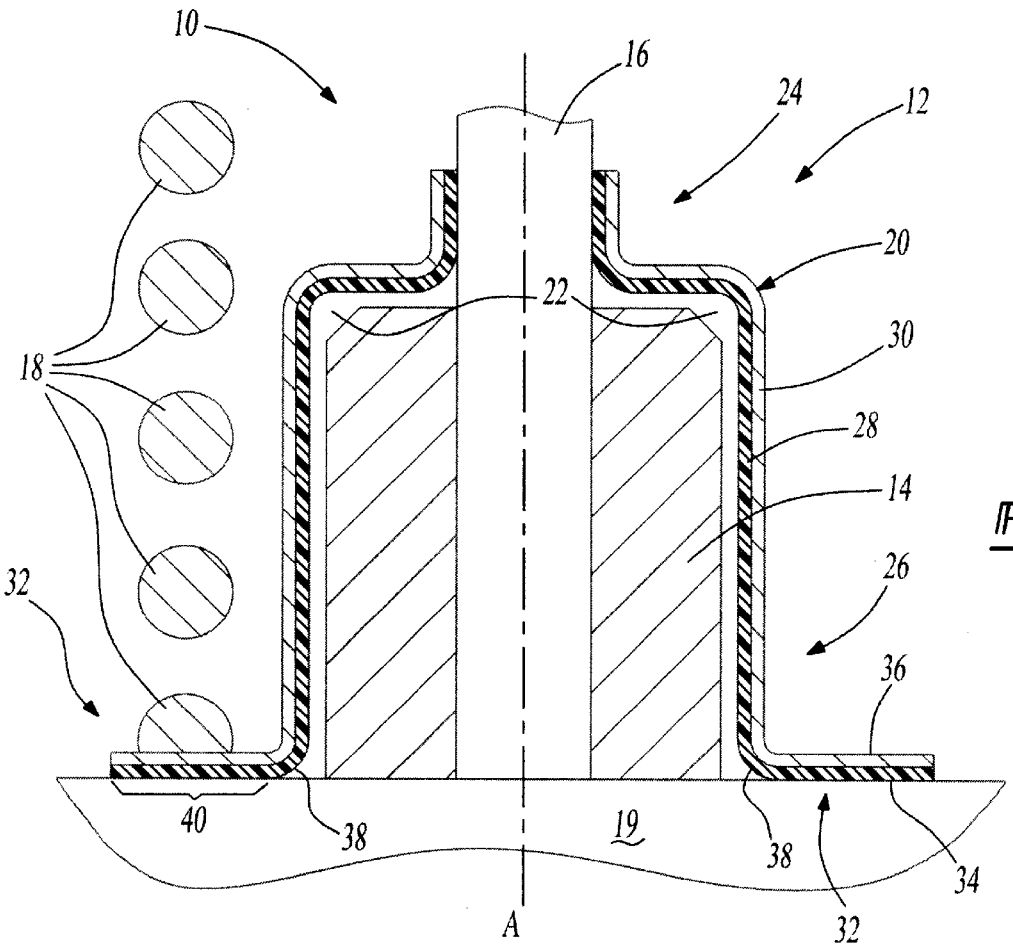
FIG. 1 shows a cross-sectional view of the valve stem seal assembly, including a valve stem seal in a common operational environment.
Figure 2:
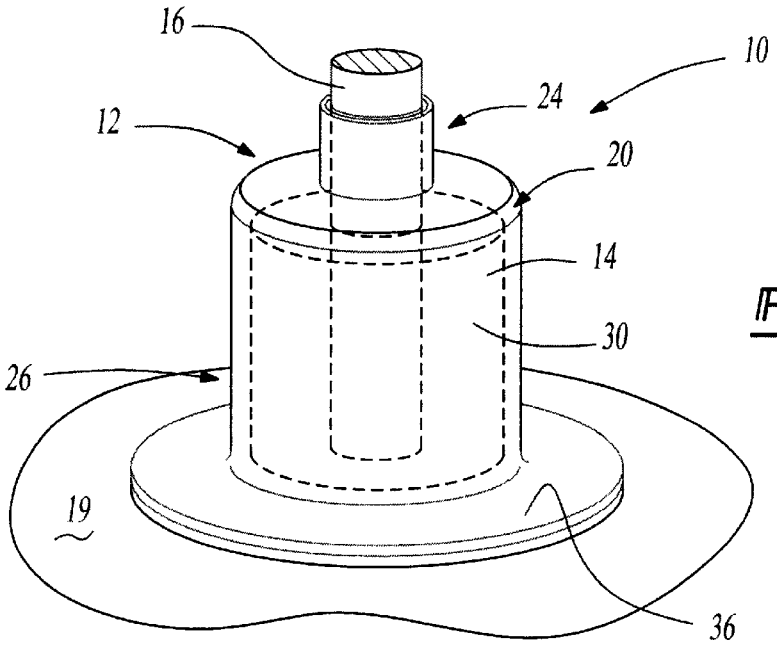
FIG. 2 is a perspective view of the assembly shown in FIG. 1 without the environmental depiction of a spring.

Referring to FIG. 1, a cross sectional view of a valve stem seal assembly 10 having a two-component construction is shown. The assembly 10 includes a valve stem seal 12, a valve stem guide 14, and a valve stem 16. Representations of a valve spring 18 and engine block head 19 are also illustrated to provide additional context for the assembly 10. FIG. 2 is merely a perspective view of the assembly shown in FIG. 1.

The valve stem seal 12 includes a sleeve 20 having a central vertical axis A, a generally concentric aperture 22 and upper and lower portions 24,26. As depicted in the embodiment shown, the sleeve 20 is comprised of at least two different material components, an inner layer 28 and an outer layer 30. The inner layer 28 will generally be in communication with the valve stem guide 14 upon insertion into the assembly 10. In the construction shown in FIG. 1, the lower portion 26 of the sleeve 20 includes an integral outwardly-extending radial flange 32 that gives the valve stem seal 12 a somewhat "top hat" configuration.

The flange 32 is in direct contact with the engine block head 19 and provides the seat for the valve spring 18 such that the valve spring 18 will not wear into the head during operation. The flange 32 has a bottom surface 34 wherein the inner layer 28 is the contact surface therebelow and a top surface 36 in which the outer layer 30 is the contact surface thereabove. In a preferred embodiment, the bottom surface 34 further includes a curved segment 38 and a generally flat segment 40. The generally flat segment 40 of the bottom surface 34 of the flange 32 contacts and is substantially planar to a corresponding area of the engine block head 19. Segment 40 helps form a lower seal that prevents oil or other matter from making its way up the valve stem guide into the stem-guide interface. The top surface 36 of the flange 32 is sufficiently rigid to support the valve spring 18 along a portion thereof.

At the upper end of the valve stem seal, the upper portion 24 of the sleeve 20 is in substantial contact with the valve stem 16. Moving down the vertical axis A toward the lower portion 26, the valve stem seal 12 flares out radially so that the diameter of the aperture 22 is sufficient to allow the seal 12 to fit over the valve guide 14. Preferably, the diameter of the aperture 22 at the top surface of the seal 12 above the valve stem guide 14 is slightly smaller than the outer diameter of the valve stem 16 to seal the stem-guide interface from oil leakage.

In some applications, the upper portion 24 of the sleeve 20 may include a metal spring reinforcement (not shown) above the valve stem guide 14. When used, the optional reinforcement can function to further ensure proper sealing through the functional life of the valve stem seal 12. Some components that can be used for the reinforcement include a split ring, a toroidal spring, or a metal band.

To facilitate the assembly of the valve stem seal 12 and other components of the assembly 10, the diameter of the aperture 22 of the sleeve 20 may be varied along the length of the vertical axis A. For example, a slight outwardly-extending taper in the aperture 22 taken along the vertical axis A in the downward direction toward the engine block head 19 can help to facilitate the assembly of the seal 12 to the valve guide 14.

The inner layer 28 of the sleeve 20 includes a resilient sealing material, preferably a rubber. However, the inner layer 28 can also be formed from other resilient rubber or plastic-type materials provided that such material is generally compatible for extrusion with the outer layer 30 and can provide an adequate seal for the intended application. Correspondingly, the outer layer 30 is comprised of a generally rigid material that can be coextruded with the inner layer 28 and provide a sufficient level of support for contacting components such as a valve seal 18. In a presently preferred embodiment the outer layer 30 is formed from a plastic material, in the form of a single layer or multi-layered construction.

The seal 12 itself is preferably formed by coextruding a generally cylindrical tube having at least an inner layer 28 and outer layer 30, although additional intermediate layers are possible and within the scope of the present invention. Any conventional coextrusion equipment suitable for coextruding articles made of one or more different materials can be used to form the coextruded tube. While the materials making up the inner and outer layers 28,30 are still in a melt or formable phase, the materials are forced through a die producing the desired tubular construction.

Referring once again to FIG. 1, it should be noted that the inner layer 28 and outer layer 30 are shown having a generally uniform thickness. However, because the inner and outer layers 28,30 are coextruded, the thickness of the inner layer 28, the outer layer 30, or both, are easily adjusted or varied along the length of the sleeve 20, including along the flange 32. Furthermore, such coextrusion can be accomplished with conventional equipment that can programmably adjust the thickness of material in preferred locations along the length of the coextruded tube. For example, an increased thickness of the rigid plastic material of the outer layer 30 can be formed in the portion of the coextruded tube that will eventually form the flange 32 to provide increased support for a valve spring 18.

In some cases, multiple extruders and specialized die systems may be needed. Because some material combinations of inner and outer layers 28,30 are not readily obtained in a melt combination die system when there are wide differences in melt temperatures or die flow characteristics a tandem extrusion can be done. In that operation, an extrusion is made and cooled, then coated on another extrusion system. For the purposes of the present invention, such tandem formations will be considered to be a form or variation of coextrusion specifically contemplated by the present invention.

After the extruded multi-layered tube has been formed, it is subsequently cut or separated into a desired length and placed in a mold to produce a valve stem seal 12, such as the type depicted in FIG. 1. Depending upon the physical properties and characteristics of the materials comprising the inner and outer layers 28,30, additional heat treatment may be needed to properly mold the materials. After the general formation of the seal 12 is completed, a curing cycle may be necessary or desired to develop the finished article properties in the inner layer 28, the outer layers 30, or both.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A valve stem having a valve stem seal, the valve stem seal comprising:

a coextruded sleeve having a central vertical axis, a substantially concentric aperture, and an upper portion and a lower portion, the upper and lower portions including an inner layer made of a first material, and an outer layer made of a second material coextruded with the first material, the upper portion forming an upper seal with the valve stem, the lower portion including an outwardly-extending radial flange having top and bottom surfaces, the bottom surface forming a lower seal with an engine block head.

2. The valve stem according to claim 1, wherein the first material is made of a resilient sealing material.

3. The valve stem according to claim 1, wherein the resilient sealing material is made of a rubber material.

4. The valve stem according to claim 1, wherein the second material is made of a rigid coextrudable material.

5. The valve stem according to claim 4, wherein the rigid coextrudable material is made of a plastic material.

6. The valve stem according to claim 1, wherein the bottom surface further includes a curved segment and a generally flat segment, the generally flat segment being substantially planar to a corresponding area of the engine block head to form the lower seal with the engine block head.

7. The valve stem according to claim 1, wherein the upper portion of the sleeve includes a metal spring reinforcement.

8. The valve stem according to claim 1, wherein a diameter of the aperture of the sleeve varies along the vertical axis of the sleeve.

9. The valve stem according to claim 8, wherein the diameter of the aperture tapers outwardly moving downwardly along the central vertical axis of the sleeve to facilitate the placement of the seal over a substantially cylindrical structural component.

10. The valve stem according to claims 9, wherein the structural component comprises a valve stem guide.

* * * * *

UNITED STATES PATENT AND TRADEMARK OFFICE

CERTIFICATE OF CORRECTION

PATENT NO. : 6,270,082 B1
DATED : August 7, 2001
INVENTOR(S) : Timothy A. Hegemier It is certified that error appears in the above-identified patent and that said Letters Patent is hereby corrected as shown below:

Title page,
Item [57], ABSTRACT, replace "includes an inner layer and inner layer of a resilient..." with -- includes an inner layer of a resilient --.

Signed and Sealed this

Twenty-sixth Day of February, 2002

*Attest:*

*Attesting Officer*

JAMES E. ROGAN
*Director of the United States Patent and Trademark Office*